US006692277B2

(12) United States Patent
Hu et al.

(10) Patent No.: US 6,692,277 B2
(45) Date of Patent: Feb. 17, 2004

(54) ELECTRICAL CARD CONNECTOR WITH SPRING SWITCH

(75) Inventors: Lun Song Hu, Kunshan (CN); Zhi Nong Yu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/293,412

(22) Filed: Nov. 12, 2002

(65) Prior Publication Data

US 2003/0236014 A1 Dec. 25, 2003

(30) Foreign Application Priority Data

Jun. 20, 2002 (TW) ..... 91209268 U

(51) Int. Cl.[7] ..... H01R 29/00
(52) U.S. Cl. ..... 439/188; 439/189
(58) Field of Search ..... 439/188, 489, 439/488, 630

(56) References Cited

U.S. PATENT DOCUMENTS 4,900,273 A 2/1990 Pernet
5,013,255 A 5/1991 Juret et al.
5,334,034 A 8/1994 Reichardt et al.
5,370,544 A 12/1994 Reichardt et al.
5,511,986 A * 4/1996 Casey et al. ..... 439/188
5,667,397 A 9/1997 Broschard, III et al.
6,004,155 A 12/1999 Wu
6,132,229 A 10/2000 Wu
6,382,994 B1 * 5/2002 Chang ..... 439/157
6,425,775 B1 7/2002 Chang
6,431,893 B1 8/2002 Chang

* cited by examiner

*Primary Examiner*—Chandrika Prasad
(74) *Attorney, Agent, or Firm*—Wei Te Chung

(57) ABSTRACT

An electrical card connector (700) has a housing (2) and a spring switch (3). The spring switch includes a first spring contact (31) and a second spring contact (32). The first and second spring contacts respectively have body portions (313, 323), contact arms (314, 324) extending from the body portions, and fixing portions (310, 320) extending from ends of the body portions. The first spring contact has an engaging portion (318) extending from the fixing portion thereof. The engaging portion and the fixing portion of the first spring contact are formed in an L-shaped configuration. The housing has a cavity (210) and a notch (212) communicating with each other for receiving the fixing portion and the engaging portion of the first spring contact.

14 Claims, 5 Drawing Sheets

ELECTRICAL CARD CONNECTOR WITH SPRING SWITCH

CROSS-REFERENCE TO RELATED APPLICATION

This present application is related to a U.S. patent application entitled to "ELECTRICAL CARD CONNECTOR WITH END POSITION SWITCH" contemporaneously filed, invented by the same inventor, and assigned to the common assignee. A copy of the specification is hereto attached for reference.

BACKGROUND OF THE INVENTION

1. Field of the Invention

The present invention relates to an electrical connector, and more particular to a card edge connector assembly having a spring switch to detect full insertion of an electrical card received therein.

2. Description of the Prior Art

Generally, an electrical card or chip card as presently used contains recording media in the card itself. This recording media or intelligence is typically in the form of a memory circuit that contains read only memory (ROM) or read/write memory (random access memory, RAM). The information stored in the read only memory or read/write memory then is used by card reader or card interface device to detect certain information. An electrical connector for receiving such an electrical card or chip card generally has a spring switch indicating whether the card is fully inserted.

U.S. Pat. No. 4,900,273, issued to Pernet on Feb. 13, 1990, discloses a conventional card connector which has an end-of-stroke contact. The end-of-stroke contact of Pernet has a moving blade and a fixed contact portion. Before an electrical card is inserted into the connector, the end-of-stroke contact is in a closed position, and a bearing surface of the fixed contact portion resiliently contacts the shaped contact surface of the moving blade. Each of the moving blade and the fixed contact portion has a blade contact received in a corresponding slot of the housing. When the electrical card is fully inserted into the connector, the card pushes a retaining finger of the moving blade, so that the shaped contact surface is pushed away from bearing surface of the fixed contact portion, and the end-of-strode contact is moved from the closed position to an open position thereby creating a corresponding signal so as to indicate that the card is fully inserted.

However, if an upward force is exerted on the moving blade falsely, the moving blade is pushed away from the fixed contact portion. As a result, the moving blade may rotate an angular distance in a vertical direction or be broken away from the housing in a worse situation. Thus the moving blade and the fixed contact portion may not properly contact with each other thereby creating a malfunctional situation.

Hence, an improved electrical connector with an improved spring switch to indicate the full insertion of an electrical card is needed to solve the above problems.

BRIEF SUMMARY OF THE INVENTION

A main object of the present invention is to provide an electrical card connector having a spring switch firmly secured in a housing of the connector.

To fulfill the above-mentioned object, an electrical card connector of present invention has a housing and a spring switch located in a rear part of the housing, and the spring switch is triggered by an electrical card inserted into the connector. The spring switch is normally in an open position, and includes a first spring contact and a second spring contact. The first spring contact is secured in front of the second spring contact. The first and second spring contacts respectively have body portions, contact arms extending from the body portions, fixing portions extending from ends of the body portions, and soldering portions extending from the fixing portions for soldering the first and second spring contacts to a printed circuit board (PCB). The first spring contact has an engaging portion extending perpendicular from the fixing portion, the engaging portion and the fixing portion are respectively received in a notch and a cavity of the housing. When the electrical card is inserted into the connector, the resilient contact portion of the first spring contact is triggered by the electrical card, and the contact arm of the first spring contact then contacts the contact arm of the second spring contact along the guide portion of the second spring contact.

Other objects, advantages and novel features of the invention will become more apparent from the following detailed description when taken in conjunction with the accompanying drawings.

DETAILED DESCRIPTION OF THE INVENTION

Figure 1:
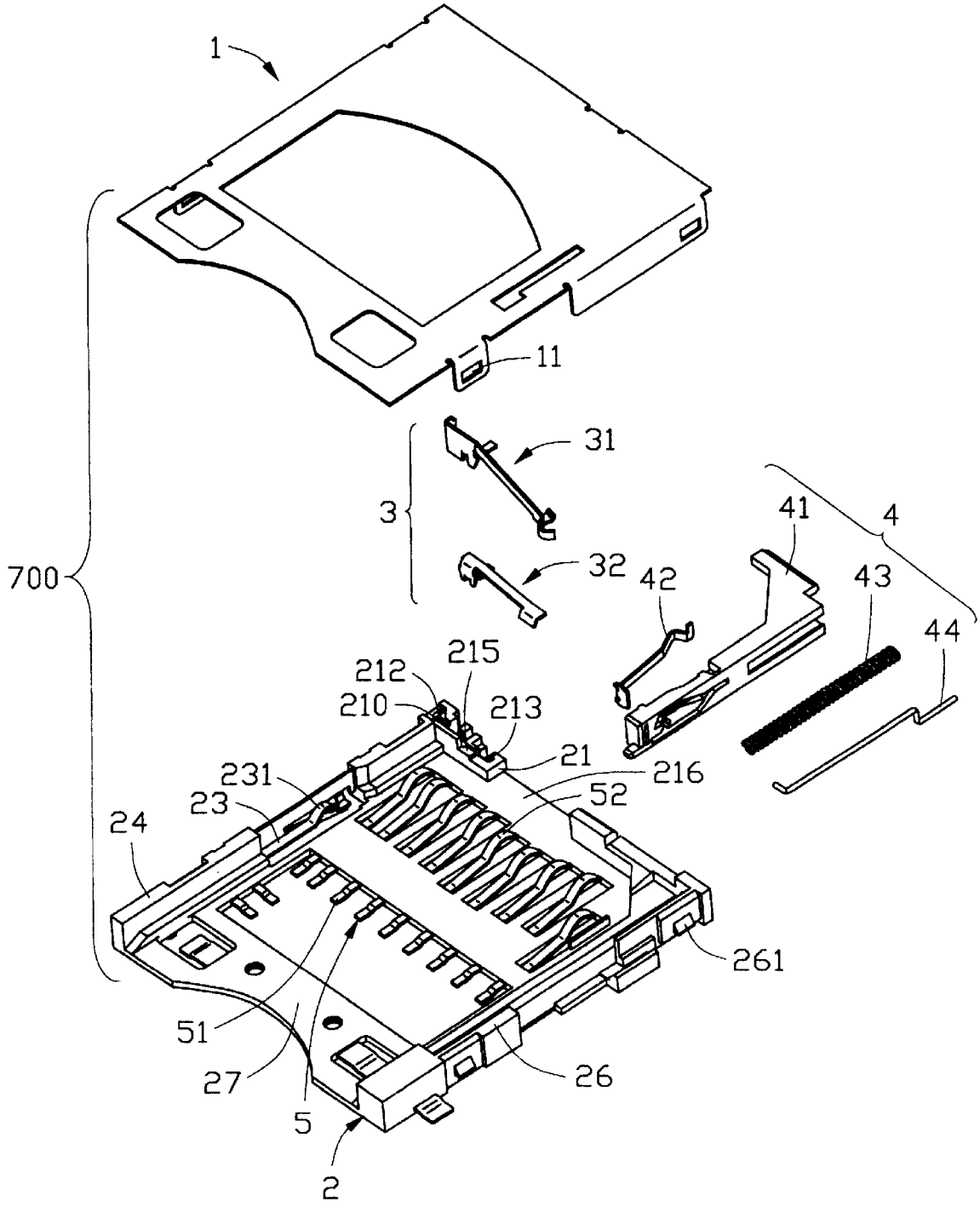
FIG. 1 is an exploded view of an electrical connector in accordance with the present invention.
Figure 2:
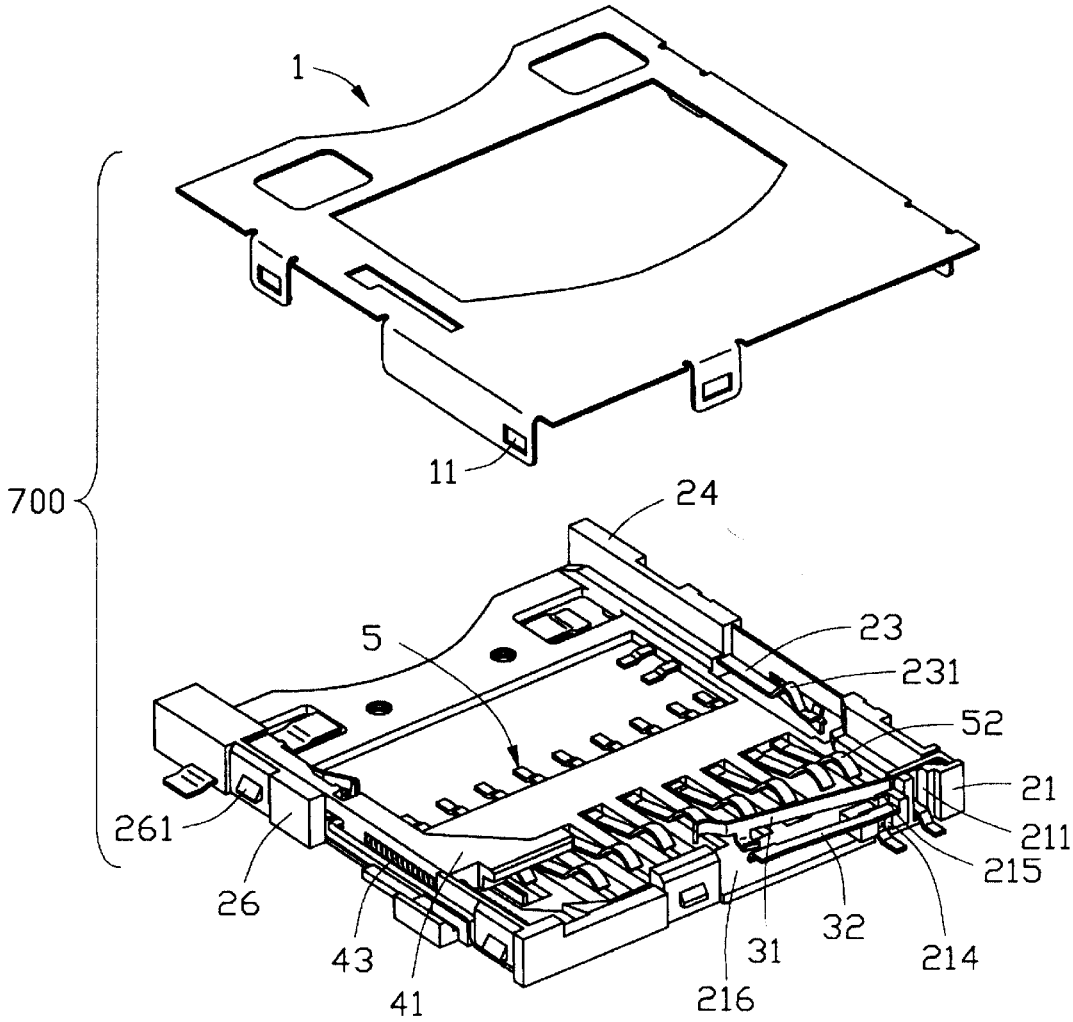
FIG. 2 is an assembled view of FIG. 1, with the shield not assembled to the housing.
Figure 3:
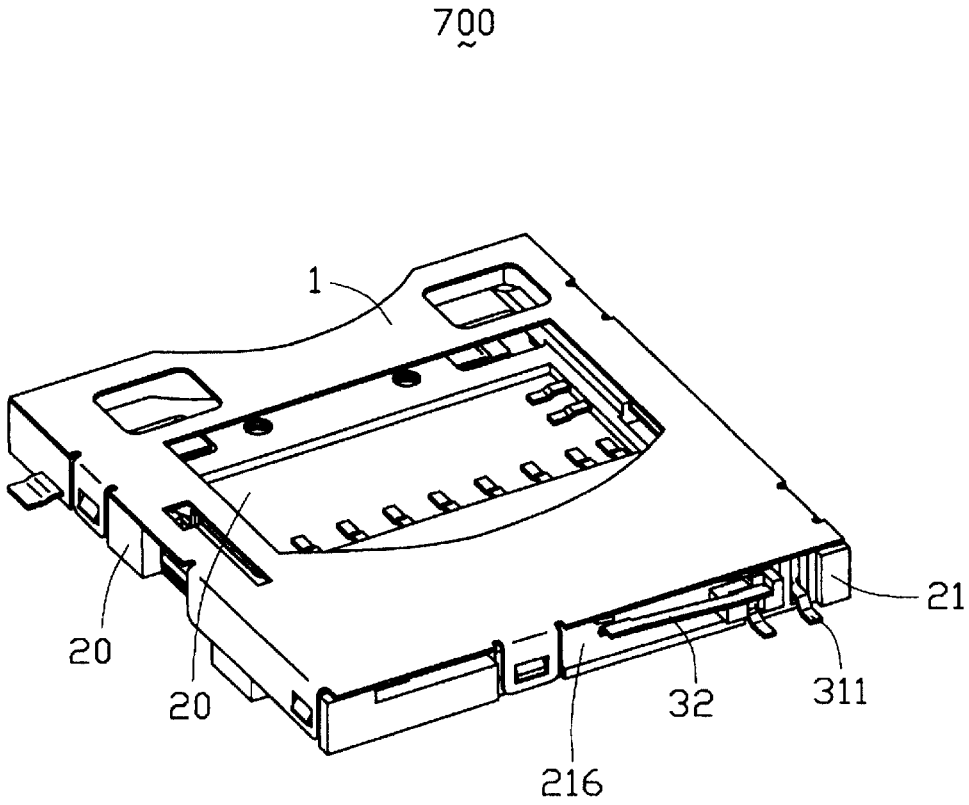
FIG. 3 is an assembled view of FIG. 1.

Referring to FIGS. 1, 2 and 3, an electrical connector 700 of present invention has a shield 1, a housing 2, a spring switch 3, and an ejector 4. The shield 1 has a plurality of openings 11. The housing 2 has a pair of peripheral rims 24, 26, and a rear rim 21 respectively extending around the two sides and partially along a rear portion of a upper surface 27 of the housing 2. The peripheral rims 24, 26 and the rear rim 21 have a plurality of locking tabs 261 for respectively engaging with the openings 11 of the shield 1. The shield 1 and the housing 2 together define a receiving slot 20 for receiving an electrical card (not shown). The ejector 4 of the electrical connector 700 has a slider 41, a sliding contact 42, a spring 43 and a rotating shaft 44.

The electrical connector 700 has a plurality of terminals 5 mounted in the housing 2. The terminals 5 are resilient and each has a soldering section 51 for soldering to a printed circuit board (PCB, not shown), and a contacting section 52 extending above the upper surface 27 of the housing 2 for engaging a corresponding contact pad on the electrical card, so that data can be read from or written into the electrical card by smart interface circuitry in a known way.

The electrical connector 700 has a relief contact 23 mounted on the peripheral rim 24 of the housing 1. The relief contact 23 has a contacting part 231 normally extending above the upper surface 27 of the housing 2 in the receiving slot 20. The relief contact 23 is for detecting if a protect switch of the inserted card is in a write-protect position. Detailed structure of the relief contact 23 is disclosed in pending U.S. patent application Ser. No. 09/876,770, so further description is omitted herein.

The spring switch 3 has a first spring contact 31 and a second spring contact 32. The rear rim 21 of the housing 1 has a pair of cavities 210, 213, a pair of grooves 211, 214 communicating with corresponding cavities 210, 213, and a notch 212 in communication with the cavity 210. The cavity 213 and the groove 214 are shaped for receiving the second spring contact 32. The first spring contact 31 and the second spring contact 32 are positioned in the rear rim 21 and separated by an insulative portion 215 of the rear rim 21. The first spring contact 31 is secured in front of the second contact 32. The rear rim 21 also defines a second opening 216 in substantially middle portion thereof.

Figure 4:
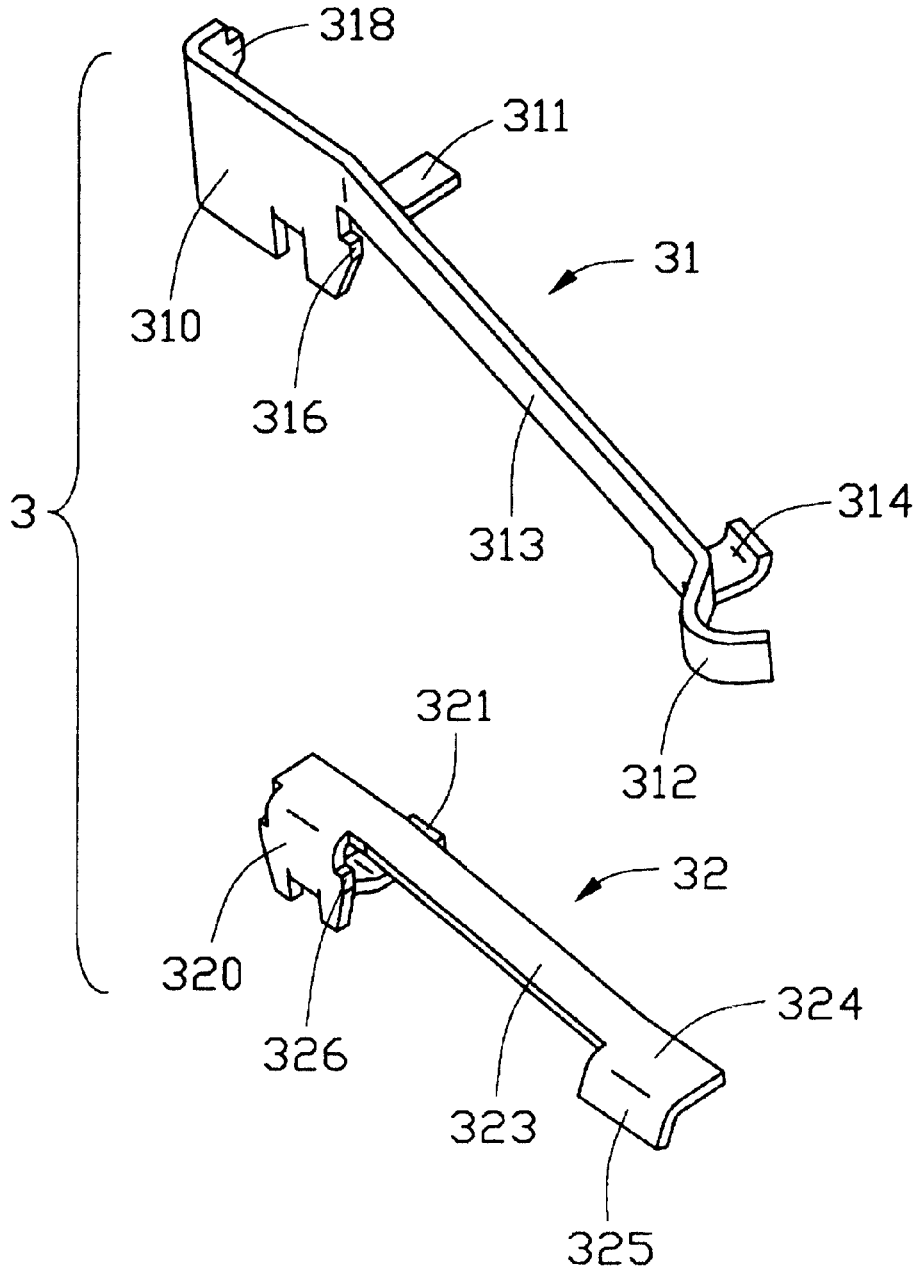
FIG. 4 is a perspective view of the spring switch in accordance with the present invention.
Figure 5:
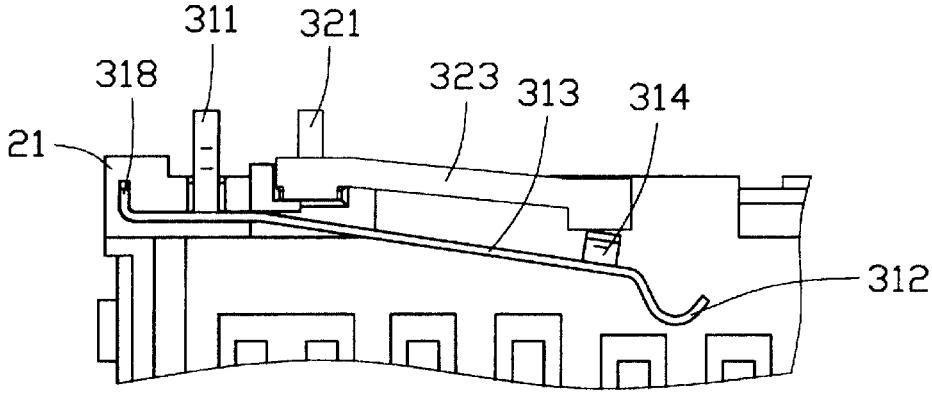
FIG. 5 is a top view of the spring switch assembled in the electrical connector before a card is inserted into the electrical connector.
Figure 6:
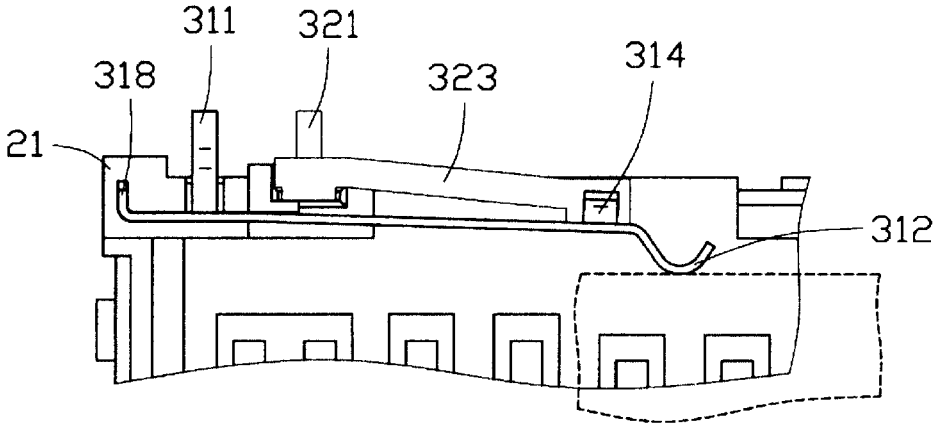
FIG. 6 is a top view of the spring switch assembled in the electrical connector after the card is inserted into the electrical connector.

Referring to FIGS. 4–6, the first spring contact 31 comprises a body portion 313, a resilient contact portion 312 slantways extending from a free end of the body portion 313, and a contact arm 314 extending adjacent to the resilient contact portion 312 for contacting the second spring contact 32. The contact arm 314 extends horizontally and rearwardly from the resilient contact portion 312 and bends slightly and upwardly at a free end thereof. The body portion 313 of the first spring contact 31 has a fixing portion 310 extending from an opposite end thereof, and a soldering portion 311 bending rearwardly from a bottom edge of the fixing portion 310 for soldering the first spring contact 31 to the PCB. The fixing portion 310 of the first spring contact 31 has an engaging portion 318 extending therefrom and perpendicular thereto. The first spring contact 31 has a barb 316 protruding downwardly from the fixing portion 310. The second spring contact 32 has a body portion 323, a contact arm 324 extending horizontally from a free end of the body portion 323, and a guide portion 325 forwardly and downwardly bending from the contact arm 324. The second spring contact 32 has a fixing portion 320 extending substantially perpendicular to the body portion 323, a pair of barbs 326 protruding downwardly from the fixing portion 320, and a soldering portion 321 bending rearwardly from a bottom edge of the fixing portion 320. The soldering portion 321 of the second spring contact 32 secures the second spring contact 32 onto the PCB.

In assembly, the ejector 4 is assembled to the peripheral rim 26 of the housing 2. The fixing portions 310, 320 of the first and second spring contacts 31, 32 are respectively received in the cavities 210, 213. The barbs 316, 326 of the spring contacts 31, 32 in the cavities 210, 213 abut against the rear rim 21 of the housing 2. The soldering portions 311, 321 of the first and second spring contacts 31, 32 respectively extend out of the rear rim 21 of the housing 2 through the grooves 211, 214. The engaging portion 318 of the first spring contact 31 engages with the notch 212 of the rear rim 21 of the housing 2. The second spring contact 32 extends into the second opening 216 of the rear rim 21 of the housing 2, and the first spring contact 31 extends into the receiving slot 20 of the housing 2 and extending away from the second spring contact 32. Thus the first spring contact 31 is secured in front of the second spring contact 32, and the first and second spring contacts 31, 32 are separated by the insulative portion 215 of the housing 2.

In use, the first spring contact 31 is not contacting with the second spring contact 32 before the electrical card is inserted into the electrical connector 700. When the electrical card is inserted into the electrical connector 700, the electrical card pushes the resilient contact portion 312 of the first spring contact 31, so that the body portion 313 of the first spring contact 31 is deflected rearwardly and the contact arm 314 then moves along the guide portion 325 and onto the contact arm 324 of the second spring contact 32. Thus, the first spring contact 31 and the second spring contact 32 contact with each other, and the state of the spring switch 3 is ON to indicate that the electrical card is inserted fully into the electrical connector 700. The ejector 4 works in a known way to eject the electrical card when the card needs to be ejected out of the electrical connector 700.

An advantage of the present invention over the prior art is that the spring contacts 31, 32 of the spring switch 3 are received in the rear rim 21 of the housing 2 and separated by the insulative portion 215. The first spring contact 31 has the engaging portion 318 extending substantially perpendicular to the fixing portion 310, and the engaging portion 318 and the fixing portion 310 are received in the notch 212 and the cavity 210. As a result, a rotation of the first spring contact 31 in vertical direction is prevented when the card pushes the first spring contact 31 to contact with the second spring contact 32. Thus the first spring contact 31 could be securely soldered to the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A connector assembly, comprising:

a housing having a rear rim at a rear end thereof, the rear rim defining a notch, and a first and second cavities, the notch communicating with the first cavity, and the notch and the first cavity located in an L-shaped position, the housing further defining a receiving space for receiving an inserted card;

a spring switch being mounted at the rear rim of the housing and comprising a first and a second spring contacts; wherein the first spring contact is moveable relative to the housing and has a first fixing portion, an engaging portion bent perpendicular from the first fixing portion and a resilient contact portion extending slantways from the fixing portion, the first fixing portion and the engaging portion formed in an L-shaped configuration and respectively received in the first cavity and the notch, the resilient contact portion being received in the receiving space of the housing; and the second spring contact is moveable relative to the housing and has a second contact arm which extends away from the first spring contact in a first position and electrically contacts with first spring contact in a second position upon the inserted card.

2. The connector assembly as claimed in claim 1, wherein the second spring contact has a second fixing portion received in the second cavity of the housing.

3. The connector assembly as claimed in claim 2, wherein the second fixing portion of the second spring contact forms a plurality of barbs engaging with the rear rim of the housing.

4. The connector assembly as claimed in claim 1, wherein the first fixing portion of the first spring contact forms a plurality of barbs engaging with the rear rim of the housing.

5. The connector assembly as claimed in claim 1, wherein the first spring contact has a first body portion, and a first contact arm extending from the first body portion.

6. The connector assembly as claimed in claim 5, wherein the first spring contact has a resilient contact portion extending slantways from the first body portion, and the first contact arm is formed adjacent to the resilient contact portion.

7. The connector assembly as claimed in claim 5, wherein the second spring contact has a guide portion extending forwardly and downwardly from the second contact arm thereof.

8. The connector assembly as claimed in claim 1, wherein the second spring contact has a second body portion, the second contact arm extends horizontally from the second body portion.

9. The connector assembly as claimed in claim 1, wherein the rear rim of the housing defines a pair of grooves, and the first and second spring contacts respectively have a first and second soldering portions received in corresponding grooves.

10. The connector assembly as claimed in claim 1, wherein the rear rim of the housing has an insulative portion for separating the first and second spring contacts.

11. An electrical connector for use with an electronic card moveable relative thereto in back-and-front directions, comprising:

a housing;

a plurality of terminals disposed in the housing;

first and second switch contacts located around a rear portion of the housing;

said first switch contact defining a first deflectable pivotal body portion adapted to be moveable relative to the housing in generally said back-and-forth directions, a first contact arm and a contact portion located around one end portion of said first deflectable pivotal body portion;

said second switch contact defining a second deflectable pivotal body portion adapted to be moveable relative to the housing in generally up-and-down directions perpendicular to said back-and forth directions, a second contact arm located around an end portion of said second deflectable pivotal body portion; wherein a lying L-shaped configuration is formed at the other end portion of the first body portion and retainably engaged with the housing so as to counterbalance back-and-forth deflection of said first body portion.

12. The connector as claimed in claim 11, wherein a horizontal soldering portion extends from a lower edge of said first body portion and is located between said L-shaped configuration and said contact portion.

13. An electrical connector for use with an electronic card moveable relative thereto in back-and-front directions, comprising:

a housing;

a plurality of terminals disposed in the housing;

a switch contact located around a rear portion of the housing;

said switch contact defining a deflectable pivotal body portion adapted to be moveable relative to the housing in generally said back-and-forth directions, a downwardly facing contact arm and a forwardly facing contact portion located around one end portion of said deflectable pivotal body portion; wherein a lying L-shaped configuration is formed at the other end portion of the body portion and retainably engaged with the housing so as to counterbalance back-and-forth deflection of said body portion.

14. The connector as claimed in claim 13, wherein a horizontal soldering portion extends from a lower edge of said body portion and is located between said L-shaped configuration and said contact portion.

* * * * *